US009513596B2

(12) United States Patent
Sato et al.

(10) Patent No.: US 9,513,596 B2
(45) **Date of Patent: *Dec. 6, 2016**

(54) IMAGE FORMING APPARATUS

(71) Applicant: BROTHER KOGYO KABUSHIKI KAISHA, Nagoya-shi, Aichi-ken (JP)

(72) Inventors: Shougo Sato, Seto (JP); Naoya Kamimura, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/015,742

(22) Filed: Feb. 4, 2016

(65) Prior Publication Data

US 2016/0154372 A1 Jun. 2, 2016

Related U.S. Application Data

(63) Continuation of application No. 14/644,667, filed on Mar. 11, 2015, now Pat. No. 9,256,196.

(30) Foreign Application Priority Data

Mar. 14, 2014 (JP) ..... 2014-051277

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 21/1676* (2013.01); *G03G 21/18* (2013.01); *G03G 21/1803* (2013.01); *G03G 21/1842* (2013.01); *G03G 21/1807* (2013.01); *G03G 21/1817* (2013.01)

(58) Field of Classification Search

CPC ..... G03G 21/18; G03G 21/1803; G03G 21/1807; G03G 21/1817

See application file for complete search history.

(56) References Cited

U.S. PATENT DOCUMENTS

| | | | |
|---|---|---|---|
| 6,282,390 | B1 | 8/2001 | Miyabe et al. |
| 7,054,578 | B2 | 5/2006 | Jung et al. |

FOREIGN PATENT DOCUMENTS

| | | | |
|---|---|---|---|
| JP | 2004-25813 | A | 1/2004 |
| JP | 2007-163529 | A | 6/2007 |

*Primary Examiner* — David Gray
*Assistant Examiner* — Michael Harrison
(74) *Attorney, Agent, or Firm* — Merchant & Gould P.C.

(57) ABSTRACT

There is provided an image forming apparatus including a main body, a drum cartridge attachable to and detachable from the main body and including a photosensitive drum, a developing agent cartridge attachable to and detachable from the main body and containing a developing agent to be supplied to the photosensitive drum, and an exposure unit configured to expose a surface of the photosensitive drum. The main body includes a drum cartridge guide which is configured to guide the drum cartridge such that the drum cartridge passes above the exposure unit, when the drum cartridge is attached to or detached from the main body, and a developing cartridge guide which is configured to guide the developing agent cartridge such that the developing agent cartridge passes below the exposure unit, when the developing agent cartridge is attached to or detached from the main body.

20 Claims, 6 Drawing Sheets

IMAGE FORMING APPARATUS

CROSS-REFERENCE TO RELATED APPLICATION

This application is a continuation patent application of U.S. Ser. No. 14/644,667, filed Mar. 11, 2015, and further claims priority from Japanese Patent Application No. 2014-051277, filed on Mar. 14, 2014, the entirety of both applications are incorporated herein by reference in its entirety.

TECHNICAL FIELD

Aspects disclosed herein relate to an image forming apparatus including a drum unit and a developing agent unit, which are attachable to and detachable from a main body of the image forming apparatus, and an exposure unit for exposing a surface of a photosensitive drum of the drum unit with light.

BACKGROUND

A known image forming apparatus includes a process unit and an exposure unit. The process unit includes, for example, a photosensitive drum and a developing agent storage. The exposure unit is disposed in front of the process unit and is configured to expose a surface of the photosensitive drum with light. The process unit is attachable to and detachable from a main body of the image forming apparatus via an upper portion of the main body.

SUMMARY

According to one or more aspects of the disclosure, an image forming apparatus may include a main body, a drum cartridge, a developing agent cartridge, and an exposure unit. The drum cartridge may be attachable to and detachable from the main body and may include a photosensitive drum. The developing agent cartridge may be attachable to and detachable from the main body and may contain a developing agent to be supplied to the photosensitive drum. The exposure unit may be configured to expose a surface of the photosensitive drum. The main body may include a drum cartridge guide and a developing cartridge guide. The drum cartridge guide may be configured to guide the drum cartridge such that the drum cartridge passes above the exposure unit, when the drum cartridge is attached to or detached from the main body. The developing cartridge guide may be configured to guide the developing agent cartridge such that the developing agent cartridge passes below the exposure unit, when the developing agent cartridge is attached to or detached from the main body.

According to one or more other aspects of the disclosure, an image forming apparatus may include a main body, a drum cartridge, a developing agent cartridge, and an exposure unit. The drum cartridge may be attachable to and detachable from the main body and may include a photosensitive drum. The developing agent cartridge may be attachable to and detachable from the main body and may contain a developing agent to be supplied to the photosensitive drum. The exposure unit may be configured to expose a surface of the photosensitive drum. The main body may include a guiding portion. The guiding portion may be configured to guide the drum cartridge such that the drum cartridge passes above the exposure unit, when the drum cartridge is attached to or detached from the main body, and may be configured to guide the developing agent cartridge such that the developing agent cartridge passes below the exposure unit, when the developing agent cartridge is attached to or detached from the main body.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

First Illustrative Embodiment

A first illustrative embodiment will be described in detail. In the description below, a general configuration of a laser printer 1 will be described and then features of the disclosure will be described. The laser printer 1 is an example of an image forming apparatus.

Figure 1:
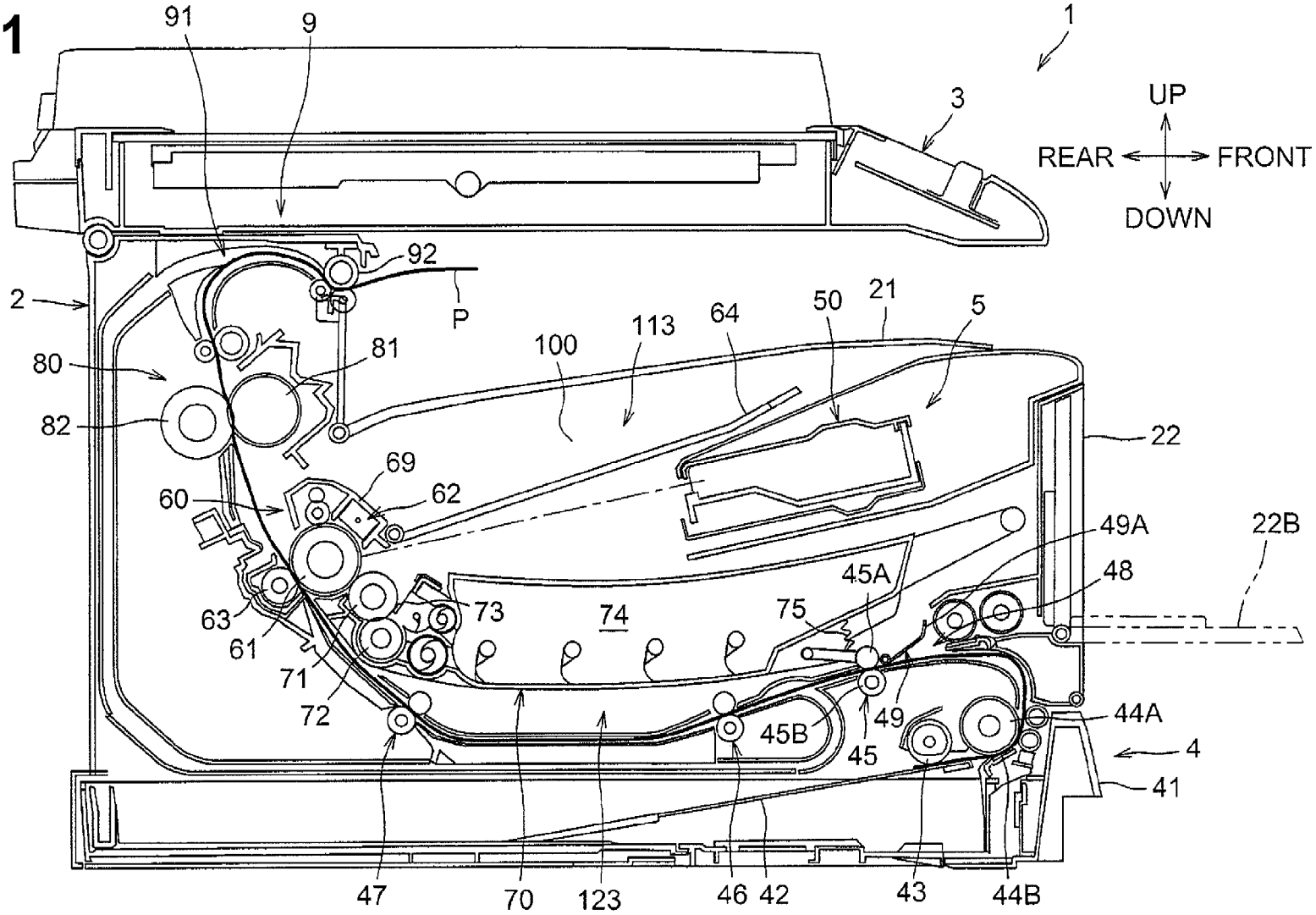
FIG. 1 is a schematic sectional view depicting a configuration of a laser printer in a first illustrative embodiment according to one or more aspects of the disclosure.

With reference to the laser printer 1, directions of up, down, right, left, front, and rear are defined with reference to an orientation of the laser printer 1 that is disposed in which it is intended to be used as depicted in FIG. 1.

<General Configuration of Laser Printer>

As depicted in FIG. 1, the laser printer 1 includes a main body 2 and a flatbed scanner 3. The flatbed scanner 3 is disposed above the main body 2. The flatbed scanner 3 is an example of a document reader. The laser printer 1 further includes a feeding unit 4, an image forming unit 5, and a discharge unit 9 within the main body 2.

The main body 2 includes a top cover 21 and a front cover 22. The top cover 21 is an example of a first openable member. The front cover 22 is an example of a second openable member. The top cover 21 is disposed at the top of the main body 2. The top cover 21 is configured to pivot between a first exposing position (e.g., a position of the top cover 21 depicted in FIG. 2) and a first closing position (e.g., a position of the top cover 21 depicted in FIG. 1). When the top cover 21 is located at the first exposing position, the top cover 21 exposes a first opening 21A that allows a drum cartridge 60 to pass therethrough. When the top cover 21 is located at the first closing position, the top cover 21 closes the first opening 21A.

The front cover 22 is disposed at the front of the main body 2. The front cover 22 is configured to pivot between a second exposing position (e.g., a position of the front cover 22 depicted in FIG. 2) and a second closing position (e.g., a position of the front cover 22 depicted in FIG. 1). When the front cover 22 is located at the second exposing position, the front cover 22 exposes a second opening 22A that allows a developing cartridge 70 to pass therethrough. The developing cartridge 70 is an example of a developing agent cartridge. When the front cover 22 is located at the second closing position, the front cover 22 closes the second opening 22A. The front cover 22 includes a manual feed tray 22B for supporting one or more sheets P thereon. In a state where the front cover 22 is located at the second exposing position, the front cover 22 functions as the manual feed tray 22B.

The flatbed scanner 3 may be a document reader having a known configuration. The flatbed scanner 3 is configured to read an image from a document by irradiating the document with light and to generate image data based on the read image at the time of copying. The flatbed scanner 3 is disposed above the main body 2 and faces the first opening 21A across the top cover 21. The flatbed scanner 3 is configured to pivot on an axis that is positioned closer to the rear than the top cover 21. In the first illustrative embodiment, by pivoting the flatbed scanner 3 upward in conjunction with the top cover 21, the first opening 21A is exposed and the drum cartridge 60 is allowed to be attached to or detached from the main body 2 via the first opening 21A.

The feeding unit 4 is configured to feed one or more sheets P to the image forming unit 5. The feeding unit 4 is disposed in a lower portion of the main body 2. The feeding unit 4 includes a feed tray 41, a sheet pressing plate 42, a pickup roller 43, a separation roller 44A, a separation pad 44B, a first conveyor roller pair 45, a second conveyor roller pair 46, and a registration roller pair 47, which define a feeding path 48.

Figure 3:
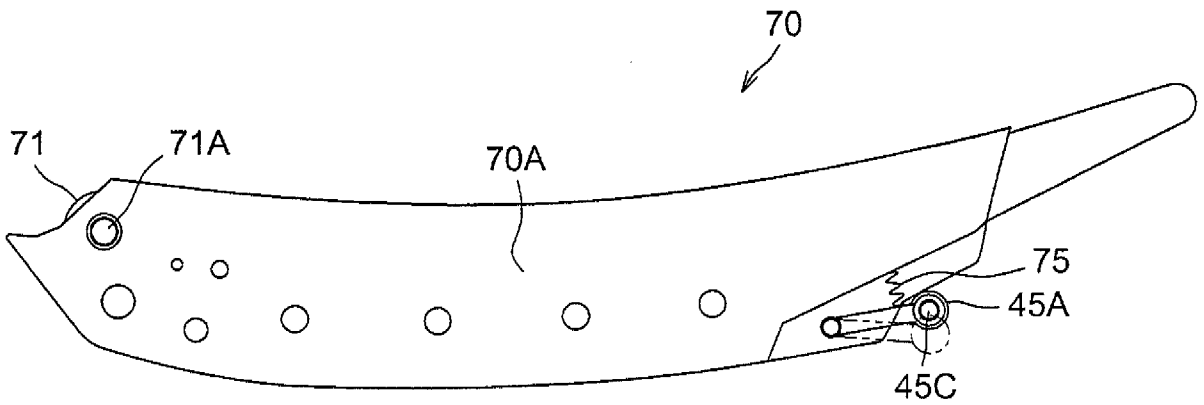
FIG. 3 is a side view of the developing cartridge in the first illustrative embodiment according to one or more aspects of the disclosure.

The first conveyor roller pair 45 includes an upper roller 45A and a lower roller 45B. The developing cartridge 70 includes the upper roller 45A of the first conveyor roller pair 45 and the main body 2 includes the lower roller 45B of the first conveyor roller pair 45. A compression spring 75 is disposed between the upper roller 45A and a front end portion of the developing cartridge 70 (refer to FIG. 3). The compression spring 75 urges the upper roller 45A toward the lower roller 45B.

The feeding path 48 is a route for conveying a sheet P fed from the feed tray 41 to the image forming unit 5, more specifically, to between the photosensitive drum 61 and the transfer roller 63. The feeding path 48 extends obliquely upward toward the front from a vicinity of the pickup roller 43 and is then curved toward the rear. The feeding path 48 further extends toward the rear so as to direct a sheet P to between the photosensitive drum 61 and the transfer roller 63. A portion of the feeding path 48 is concavely curved between the second conveyor roller pair 46 and the registration roller pair 47, more specifically, below the developing cartridge 70.

A plate-shaped guide member 49 is disposed in front of the first conveyor roller pair 45. The guide member 49 is configured to move up and down on an axis that is located in front of a vicinity of the first conveyor roller pair 45. The guide member 49 includes an end portion 49A that is moved by an interlock member (not depicted) in synchronization with opening or closing of the front cover 22. More specifically, the end portion 49A of the guide member 49 moves upward in response to closing of the front cover 22, and the end portion 49A of the guide member 49 moves downward in response to the opening of the front cover 22 (refer to FIG. 2).

The feed tray 41 supports one or more sheets P thereon. The sheet pressing plate 42 moves the one or more sheets P toward the pickup roller 43 and the pickup roller 43 picks and feeds the one or more sheets P. The separation roller 44A and the separation pad 44B separate and convey, one by one, the one or more fed sheets P in conjunction with each other. The separated sheet P is bent into a generally U shape at the front portion of the main body 2. Then, the first conveyor roller pair 45 and the second conveyor roller pair 46 further convey the sheet P. Thereafter, the registration roller pair 47 corrects skewing of the sheet P and further conveys the sheet P toward the image forming unit 5.

The image forming unit 5 is configured to form an image onto the fed sheet P. The image forming unit 5 is disposed above the feed tray 41 and below the top cover 21. The image forming unit 5 includes an exposure unit 50, the drum cartridge 60, the developing cartridge 70, and a fixing unit 80.

The exposure unit 50 is disposed in a front portion of the main body 2. The exposure unit 50 includes a laser-emitting portion, a polygon mirror, and lenses (not depicted). The exposure unit 50 performs high-speed scanning to irradiate a surface of the photosensitive drum 61 with a laser beam which travels in an optical path as indicated by a dotted-and-dashed line in FIG. 1 when the drum cartridge 60 is located at an attached position.

The drum cartridge 60 is disposed behind the exposure unit 50 and is configured to be attachable to and detachable from the main body 2. The drum cartridge 60 includes a drum frame 69, the photosensitive drum 61, a charger 62, and the transfer roller 63. The photosensitive drum 61, the charger 62, and the transfer roller 63 are disposed inside the drum frame 69.

The developing cartridge 70 is disposed below the drum cartridge 60 and is configured to be attachable to and detachable from the main body 2. The developing cartridge 70 includes a developing roller 71, a supply roller 72, a layer thickness regulating blade 73, and a toner storage 74.

The drum cartridge 60 and the developing cartridge 70 are supported by right and left side frames 100 of the main body 2.

The fixing unit 80 is disposed above a rear end portion of the drum cartridge 60. The fixing unit 80 includes a heating roller 81 and a pressing roller 82. The pressing roller 82 faces the heating roller 81 and presses the heating roller 81.

In the image forming unit 5, the charger 62 charges the surface of the photosensitive drum 61 uniformly. Then, the exposure unit 50 performs high-speed scanning to expose the charged surface of the photosensitive drum 61 with a laser beam. Thus, an electrostatic latent image is formed on the surface of the photosensitive drum 61. The supply roller 72 supplies toner to the developing roller 71 from the toner storage 74, and the developing roller 71 carries the toner thereon.

Then, the developing roller 71 supplies the toner onto the electrostatic latent image held on the surface of the photosensitive drum 61, thereby visualizing the electrostatic latent image to form a toner image on the surface of the photosensitive drum 61. Thereafter, the transfer roller 63 transfers the toner image onto a sheet P from the surface of the photosensitive drum 6 when the sheet P fed from the feeding unit 4 passes between the photosensitive drum 61 and the transfer roller 63. When the sheet P passes between the heating roller 81 and the pressing roller 82, the heating roller 81 and the pressing roller 82 thermally fix the transferred toner image onto the sheet P.

The discharge unit 9 is configured to convey a sheet P having a thermally-fixed toner image to the outside of the main body 2. The discharge unit 9 includes a discharge roller 92 and defines a discharging path 91.

The discharging path 91 is a route for guiding, toward the top cover 21, a sheet P conveyed from the image forming unit 5, while bending the sheet P. The top cover 21 is disposed above the drum cartridge 60. The top cover 21 functions as a discharge tray when the top cover 21 is located at the first closing position.

The discharge unit 9 conveys a sheet P, which has an image thereon and has passed the image forming unit 5, while bending the sheet P into a generally U shape at a rear portion of the main body 2. Then, the discharge unit 9 discharges the sheet P to the outside of the main body 2 using the discharge roller 92. The discharged sheet P is placed on the top cover 21.

<Configuration of Side Frames>

Hereinafter, the side frames 100 will be described.

Figure 2:
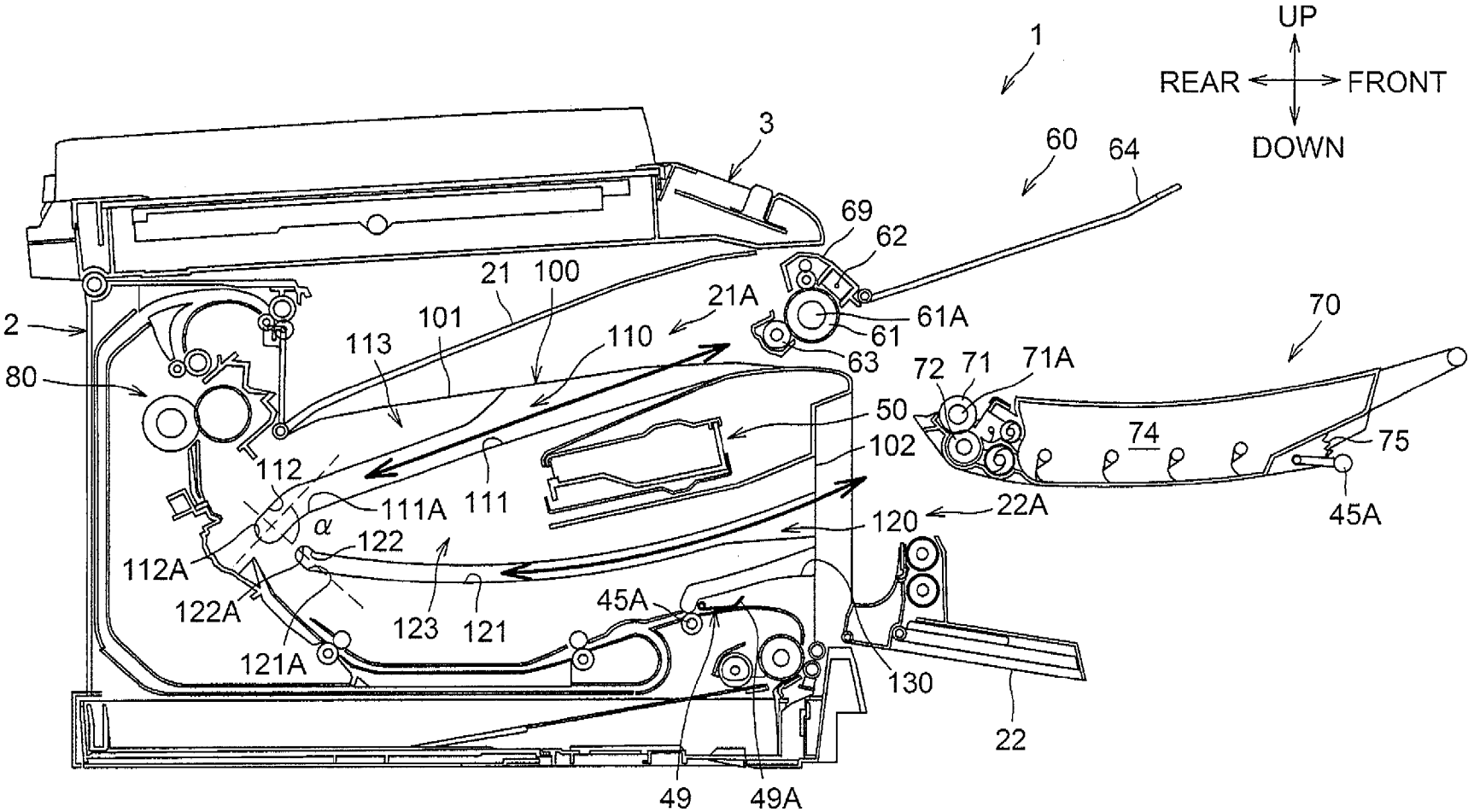
FIG. 2 is a schematic sectional view depicting the configuration of the laser printer of FIG. 1 from which a drum cartridge and a developing cartridge are detached in the first illustrative embodiment according to one or more aspects of the disclosure.

The side frames 100 have symmetric configuration, and each include a drum cartridge guide 110, a developing cartridge guide 120, and a conveying roller guide 130 as depicted in FIG. 2.

The drum cartridge guides 110 each include a groove for guiding movement of the drum cartridge 60 at the time of attaching or detaching the drum cartridge 60 with respect to the main body 2 via the first opening 21A. The drum cartridge guides 110 support the drum cartridge 60 when the drum cartridge 60 is attached in the main body 2. The drum cartridge guides 110 allow a photosensitive drum shaft 61A to pass therethrough. The drum cartridge guides 110 each include a first drum-cartridge guide portion 111 and a second drum-cartridge guide portion 112.

The first drum-cartridge guide portions 111 extend obliquely downward toward the rear (e.g., a first direction) from respective upper ends 101 of the side frames 100. The first drum-cartridge guide portions 111 are configured to guide the drum cartridge 60 such that the drum cartridge 60 passes above the exposure unit 50 at the time of attaching or detaching the drum cartridge 60 with respect to the main body 2.

The second drum-cartridge guide portions 112 extend from respective downstream ends 111A of the first drum-cartridge guide portions 111. The second drum-cartridge guide portions 112 extend obliquely downward at a greater degree of inclination than the first drum-cartridge guide portions 111. When the drum cartridge 60 is attached in the main body 2, end portions of the photosensitive drum shaft 61A are positioned in respective downstream end portions 112A of the second drum-cartridge guide portions 112.

As depicted in FIG. 1, the drum cartridge 60 includes a handle 64 at a rear end of the drum frame 69 so as to be pivotable. In a state where the drum cartridge 60 is attached in the main body 2, the handle 64 of the drum cartridge 60 is positioned in a path 113 for attaching and detaching the drum cartridge 60 defined by the drum cartridge guides 110.

The handle 64 is held by a user at the time of attaching the drum cartridge 60 to the main body 2 and detaching the drum cartridge 60 from the main body 2. In the state where the drum cartridge 60 is attached in the main body 2, the handle 64 extends to above the exposure unit 50 from the rear end of the drum frame 69.

As depicted in FIG. 2, the developing cartridge guides 120 each include a groove for guiding movement of the developing cartridge 70 at the time of attaching or detaching the developing cartridge 70 with respect to the main body 2. The developing cartridge guides 120 support the developing cartridge 70 when the developing cartridge 70 is attached in the main body 2. The developing cartridge guides 120 are configured to guide the developing cartridge 70 to a second attached position. The developing cartridge guides 120 allow a developing roller shaft 71A to pass therethrough. The right and left end portions of the developing roller shaft 71A protrude from respective side surfaces 70A (only a right side surface 70A is depicted) of the developing cartridge 70 (refer to FIG. 3). The developing cartridge guides 120 each include a first developing-cartridge guide portion 121 and a second developing-cartridge guide portion 122.

The first developing-cartridge guide portions 121 extend generally toward the rear (e.g., a second direction) from respective front ends 102 of the side frames 100. The first developing-cartridge guide portions 121 are configured to guide the developing cartridge 70 such that the developing cartridge 70 passes below the exposure unit 50 at the time of attaching or detaching the developing cartridge 70 with respect to the main body 2. The first developing-cartridge guide portions 121 are concavely curved below the exposure unit 50 so as to be distanced from the exposure unit 50.

The second developing-cartridge guide portions 122 are disposed downstream of the respective first developing-cartridge guide portions 121 in an attaching and detaching direction of the developing cartridge 70. The second developing-cartridge guide portions 122 extend from respective downstream ends 121A of the first developing-cartridge guide portions 121. The second developing-cartridge guide portions 122 extend obliquely upward at a greater degree of inclination than the first developing-cartridge guide portions 121. The second developing-cartridge guide portions 122 are configured to guide the developing roller shaft 71A to a particular position at which the developing roller 71 contacts the photosensitive drum 61 whose shaft 61A is positioned in the downstream end portions 112A of the second drum-cartridge guide portions 112. When the developing cartridge 70 is attached in the main body 2, the protruding end portions of the developing roller shaft 71A are positioned in respective downstream end portions 122A of the second developing-cartridge guide portions 122.

An inclination angle $\alpha$ of the second drum-cartridge guide portion 112 with respect to the second developing-cartridge guide portion 122 is an obtuse angle.

As depicted in FIG. 1, in a state where the developing cartridge 70 is attached in the main body 2, the toner storage 74 is positioned in a path 123 for attaching or detaching the developing cartridge 70 defined by the developing cartridge guides 120.

The toner storage 74 extends between a vicinity of the developing roller 71 and below the exposure unit 50. Therefore, a rear portion of the exposure unit 50 is positioned between the drum cartridge 60 and the developing cartridge 70 in a state where the drum cartridge 60 and the developing cartridge 70 are both attached in the main body 2.

As depicted in FIG. 2, the conveying roller guides 130 each include a groove for guiding the upper roller 45A of the first conveyor roller pair 45 to a particular position at which the upper roller 45 A corresponds to the lower roller 45B of the first conveyor roller pair 45. The conveying roller guides 130 support a shaft 45C (refer to FIG. 3) of the upper roller 45A when the developing cartridge 70 is attached in the main body 2. The conveying roller guides 130 each include a first portion that extends obliquely downward toward the rear from a respective front end 102 of the side frame 100 and a second portion that extends obliquely downward at a greater degree of inclination than the first portions.

Hereinafter, effects obtained by the laser printer 1 configured as described above will be described.

When the toner storage 74 becomes empty of toner, the developing cartridge 70 is detached from the main body 2 to replace the developing cartridge with a new one. In the first illustrative embodiment, the developing cartridge 70 is detached from the main body 2 via the second opening 22A, which is exposed by the opened front cover 22, while the developing cartridge 70 passes below the exposure unit 50. Therefore, the developing cartridge 70 might not interfere with the exposure unit 50 at the time of detaching the developing cartridge 70 from the main body 2. Further, there is a space below the exposure unit 50, whereby the developing cartridge 70 including the toner storage 74 having relatively larger storage capacity may be detached without interfering with the exposure unit 50 through use of the space.

At the time of detaching the drum cartridge 60 from the main body 2, the drum cartridge 60 is pulled out from the main body 2 via the first opening 21A, which is exposed by the opened top cover 21 of the main body 2, while the drum cartridge 60 passes above the exposure unit 50. With this configuration, the drum cartridge 60 and the developing cartridge 70 may be detached from the main body 2 via the first opening 21A and the second opening 22A, respectively, without interfering with each other.

A new drum cartridge 60 is attached to the main body 2 via the first opening 21A while passing above the exposure unit 50. A new developing cartridge 70 is attached to the main body 2 via the second opening 22A while passing below the exposure unit 50. Therefore, the drum cartridge 60 and the developing cartridge 70 may be attached to the main body 2 via the first opening 21A and the second opening 22A, respectively, without interfering with each other.

The inclination angle $\alpha$ of the second drum-cartridge guide portion 112 with respect to the second developing-cartridge guide portion 122 is an obtuse angle. Therefore, at the time of attaching one of the drum cartridge 60 and the developing cartridge 70 to the main body 2, one of the drum cartridge 60 and the developing cartridge 70 may be moved closer to the other of the drum cartridge 60 and the developing cartridge 70 after the one of the drum cartridge 60 and the developing cartridge 70 reaches a rear position in the main body 2. Further, at the time of detaching one of the drum cartridge 60 and the developing cartridge 70 from the main body 2, one of the drum cartridge 60 and the developing cartridge 70 may be moved away from the other of the drum cartridge 60 and the developing cartridge 70 at the rear position in the main body 2 before the one of the drum cartridge 60 and the developing cartridge 70 is detached from the main body 2. Therefore, at the time of attaching and detaching the drum cartridge 60 and the developing cartridge 70 with respect to the main body 2, an interference of the photosensitive drum 61 and the developing roller 71 with each other may be prevented or reduced.

The flatbed scanner 3 is disposed above the main body 2. Even when the flatbed scanner 3 is pivoted upward in conjunction with the top cover 21, the opening 21A defined between the flatbed scanner 3 and the main body 2 is relatively small. If, for example, a cartridge including both a drum cartridge and a developing cartridge is attached to or detached from the main body 2 via such a small opening 21A, it may be difficult to attach or detach such a cartridge to or from the main body 2.

According to the first illustrative embodiment, only the drum cartridge 60 passes through the first opening 21A. Therefore, the presence of the flatbed scanner 3 might not influence on increase in toner storage capacity of the toner storage 74 of the developing cartridge 70. Further, the drum cartridge 60 may be attached to or detached from the main body 2 without pivoting the flatbed scanner 3 greatly.

In a state where the drum cartridge 60 and the developing cartridge 70 are both attached in the main body 2, the drum cartridge 60 and the developing cartridge 70 are positioned on either side of the exposure unit 50. That is, the drum cartridge 60 (e.g., the handle 64) and the developing cartridge 70 (e.g., the toner storage 74) are disposed closer to the first opening 21A and the second opening 22A, respectively. Therefore, the drum cartridge 60 and the developing cartridge 70 may be detached from the main body 2 easily via the first opening 21A and the second opening 22A, respectively.

Second Illustrative Embodiment

Hereinafter, a second illustrative embodiment will be described. In the description below, common parts have the same reference numerals as those of the above-described embodiment, and the detailed description of the common parts is omitted.

Figure 4:
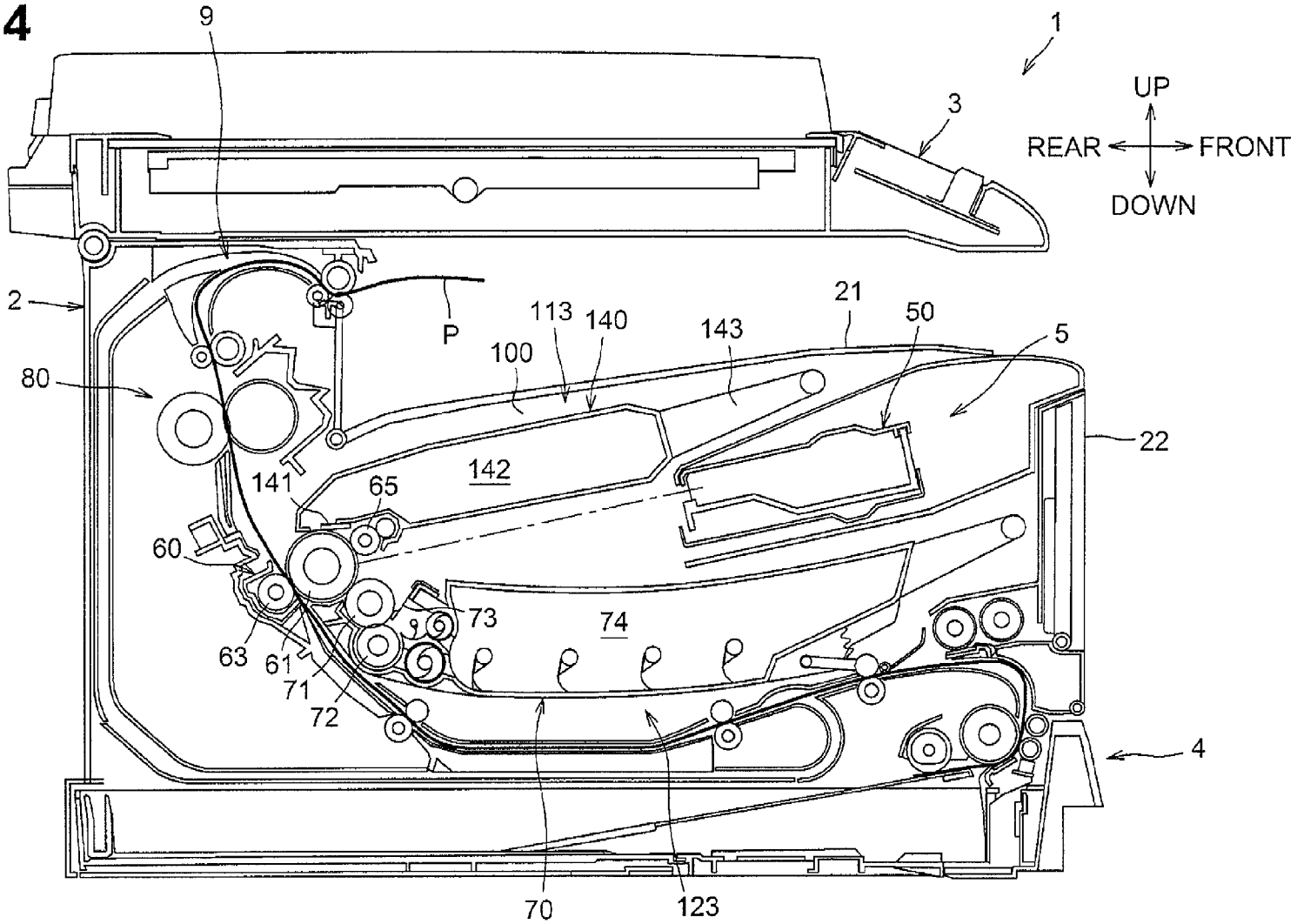
FIG. 4 is a schematic sectional view depicting a configuration of a laser printer in a second illustrative embodiment according to one or more aspects of the disclosure.

As depicted in FIG. 4, a drum cartridge 60 according to the second illustrative embodiment includes a charging roller 65 instead of the charger 62 according to the first illustrative embodiment. The drum cartridge 60 further includes a cleaning unit 140 at an upper portion thereof. The cleaning unit 140 includes a cleaning member 141 and a waste toner storage 142.

The cleaning member 141 includes a blade for removing and collecting toner from the surface of the photosensitive drum 61. A portion of a lower surface of the cleaning member 141 is in contact with an upper surface of the photosensitive drum 6.

The waste toner storage 142 is configured to store toner collected using the cleaning member 141. In a state where the drum cartridge 60 is attached in the main body 2, the waste toner storage 142 extends from a position corresponding to the photosensitive drum 61 to a rear end of the exposure unit 50 that is disposed in front of the waste toner storage 142. The waste toner storage 142 includes a handle 143 at a front end thereof to be held by the user. In the state where the drum cartridge 60 is attached in the main body 2, the handle 143 extends from the front end of the waste toner storage 142 to above the exposure unit 50. Therefore, a portion of the exposure unit 50 is positioned between the handle 143 (e.g., a portion of the drum cartridge 60) and the developing cartridge 70.

Figure 5:
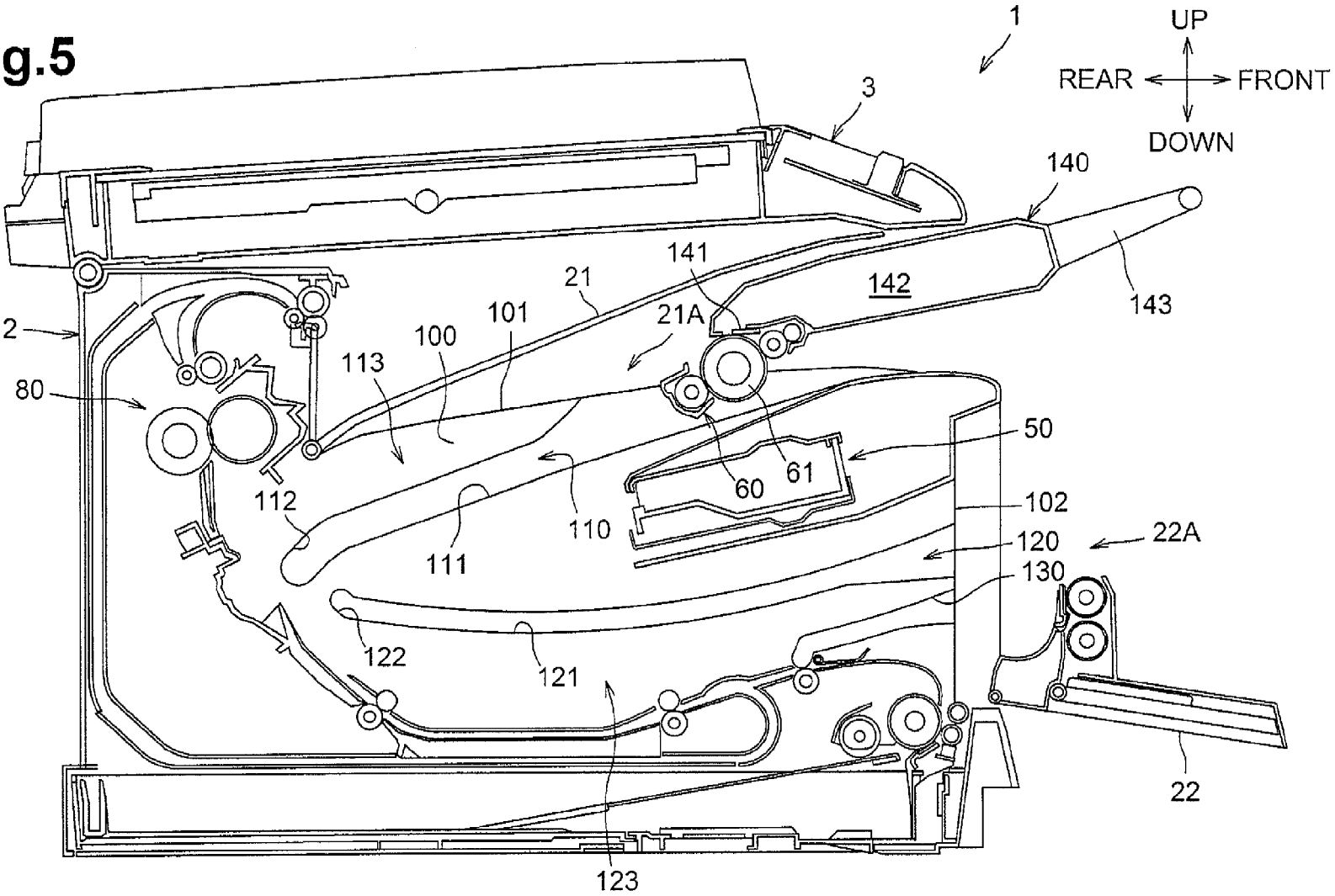
FIG. 5 is a schematic sectional view depicting the configuration of the laser printer of FIG. 4 from which a drum cartridge is detached in the second illustrative embodiment according to one or more aspects of the disclosure.

In the laser printer 1 configured as described above, when the waste toner storage 142 becomes full of waste toner, the waste toner storage 142, i.e., the drum cartridge 60, is replaced with a new one. To replace the drum cartridge 60, as depicted in FIG. 5, after opening the top cover 21, the user holds the handle 143 and pulls out the drum cartridge 60 via the first opening 21A. Then, the user inserts a new drum cartridge 60 with empty waste toner storage 142 into the main body 2 via the first opening 21A to place the drum cartridge 60 at a first attached position.

In a case where the toner storage 74 has a larger toner storage capacity, an amount of toner to be wasted increases.

Therefore, the toner storage capacity of the waste toner storage 142 needs to be also increased. In the second illustrative embodiment, there is a space above the exposure unit 50 and the drum cartridge 60 including the waste toner storage 142 is positioned in the space. This space may enable the drum cartridge 60 to have the waste toner storage 142 with larger toner storage capacity.

While the disclosure has been described in detail with reference to example embodiments thereof, it is not limited to such examples. Various changes, arrangements and modifications may be applied to the detailed configuration without departing from the spirit and scope of the disclosure.

Figure 6:
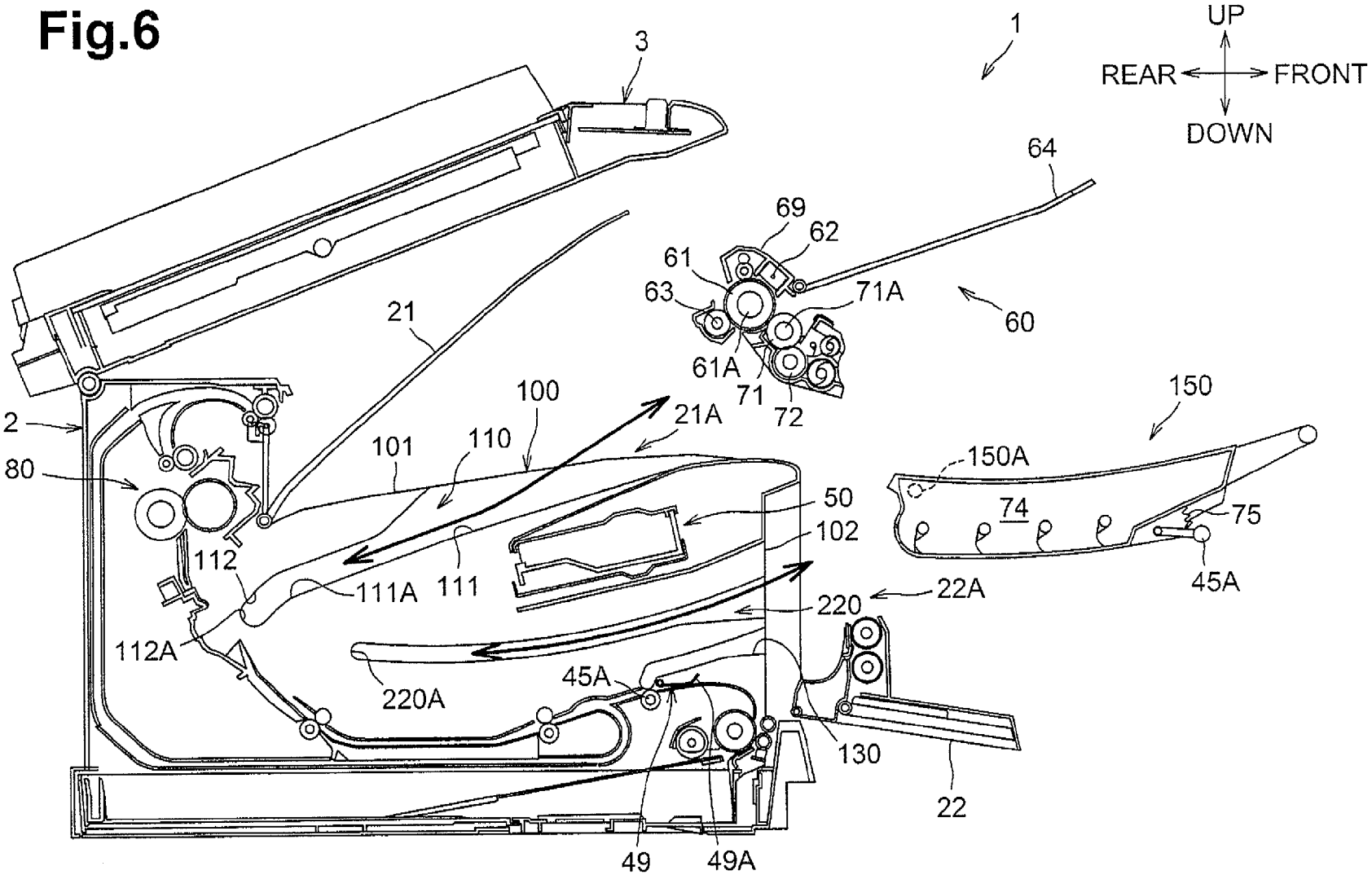
FIG. 6 is a schematic sectional view depicting a configuration of a laser printer from which the drum cartridge and the toner cartridge are detached in a variation according to one or more aspects of the disclosure.

In the above-described illustrative embodiments, the developing cartridge 70 includes the developing roller 71. Nevertheless, in other embodiments, for example, as depicted in FIG. 6, the drum cartridge 60 includes the developing roller 71.

In this case, the drum cartridge 60 includes the developing roller 71 and the supply roller 72 as well as the photosensitive drum 61. A toner cartridge 150 includes the toner storage 74. The toner cartridge 150 is configured such that the toner cartridge 150 is positioned in front of the supply roller 72 and at a position that the toner cartridge 150 is able to supply toner to the supply roller 72 in a state where the toner cartridge 150 is attached in the main body 2. The toner cartridge 150 is an example of a developing agent cartridge.

The side frames 100 each include a toner cartridge guide 220. The toner cartridge guides 220 each include a groove for guiding movement of the toner cartridge 150 at the time of attaching or detaching the toner cartridge 150 with respect to the main body 2. The toner cartridge guides 220 support a shaft 150A protruding from right and left side surfaces of the toner cartridge 150. The toner cartridge guides 220 extend from the respective front ends 102 of the side frames 100 to respective vicinities of a front surface of the supply roller 72 of the drum cartridge 60 that is attached in the main body 2. In a state where the toner cartridge 150 is attached in the main body 2, end portions of the shaft 150A are positioned in respective downstream end portions 220A of the toner cartridge guides 220.

In the above-described illustrative embodiments, a portion of the exposure unit 50 is positioned between the drum cartridge 60 and the developing cartridge 70. Nevertheless, in other embodiments, for example, an entire portion of the exposure unit 50 may be positioned between the drum cartridge 60 and the developing cartridge 70. In still other embodiments, the exposure unit 50 might not be positioned between the drum cartridge 60 and the developing cartridge 70.

In the above-described illustrative embodiments, the inclination angle $\alpha$ of the second drum-cartridge guide portion 112 with respect to the second developing-cartridge guide portion 122 is an obtuse angle. Nevertheless, in other embodiments, for example, the inclination angle $\alpha$ of the second drum-cartridge guide portion 112 with respect to the second developing-cartridge guide portion 122 may be a right angle.

In the above-described illustrative embodiments, the laser printer 1 includes the flatbed scanner 3. Nevertheless, in other embodiments, for example, the laser printer 1 might not include the flatbed scanner 3.

In the above-described illustrative embodiments, the monochrome laser printer 1 is illustrated as an example of the image forming apparatus. Nevertheless, in other embodiments, the image forming apparatus may include, for example, a copying machine.

What is claimed is:

1. An image forming apparatus comprising:

a main body;

a drum cartridge attachable to and detachable from the main body, the drum cartridge including a photosensitive drum;

a developing agent cartridge attachable to and detachable from the main body, the developing agent cartridge containing a developing agent to be supplied to the photosensitive drum; and an exposure unit configured to expose a surface of the photosensitive drum, the main body having:

a first opening which is positioned above the exposure unit and through which the drum cartridge passes when the drum cartridge is attached to or detached from the main body;

a second opening through which the developing agent cartridge passes when the developing agent cartridge is attached to or detached from the main body; and a developing agent cartridge guide configured to guide the developing agent cartridge which has passed through the second opening, wherein the developing agent cartridge guide is configured such that, when the developing agent cartridge is attached to or detached from the main body, the developing agent cartridge passes below the exposure unit.

2. The image forming apparatus according to claim 1, wherein the developing agent cartridge guide extends below the exposure unit.

3. The image forming apparatus according to claim 1, further comprising a drum cartridge guide continuous from the first opening and configured to guide the drum cartridge which has passed through the first opening.

4. The image forming apparatus according to claim 3, wherein the drum cartridge guide extends above the exposure unit.

5. The image forming apparatus according to claim 1, wherein the second opening is positioned below the exposure unit.

6. The image forming apparatus according to claim 1, further comprising:

a first openable member movable with respect to the main body, the first openable member configured to move between a first exposing position at which the first openable member exposes the first opening and a first closing position at which the first openable member closes the first opening; and a second openable member movable with respect to the main body, the second openable member configured to movable between a second exposing position at which the second openable member exposes the second opening and a second closing position at which the second openable member closes the second opening.

7. The image forming apparatus according to claim 6, wherein the first openable member is configured to open/close an upper surface of the main body, and the second openable member is configured to open/close a side surface of the main body.

8. The image forming apparatus according to claim 1, wherein a portion of the exposure unit is positioned between the drum cartridge and the developing agent cartridge in a state where the drum cartridge and the developing agent cartridge are attached in the main body.

9. An image forming apparatus comprising:

a main body;

a first cartridge attachable to and detachable from the main body, the first cartridge including a first image forming rotating element;

a second cartridge attachable to and detachable from the main body; and an exposure unit configured to emit a laser beam, the main body having:

a first opening which is positioned above the exposure unit and through which the first cartridge passes when the first cartridge is attached to or detached from the main body;

a second opening through which the second cartridge passes when the second cartridge is attached to or detached from the main body; and a lower guide configured to guide the second cartridge which has passed through the second opening, wherein the lower guide is configured such that, when the second cartridge is attached to or detached from the main body, the second cartridge passes below the exposure unit.

10. The image forming apparatus according to claim 9, wherein the first cartridge is a drum cartridge including a photosensitive drum, and the second cartridge is a developing agent cartridge including a developing roller.

11. The image forming apparatus according to claim 9, wherein the first image forming rotating element is a photosensitive drum, and wherein the second cartridge is a developing agent cartridge that includes a developing roller configured to develop a developing agent image on the photosensitive drum.

12. The image forming apparatus according to claim 9, wherein the lower guide extends below the exposure unit.

13. The image forming apparatus according to claim 9, further comprising an upper guide configured to guide the first cartridge which has passed through the first opening.

14. The image forming apparatus according to claim 13, wherein the upper guide extends above the exposure unit.

15. The image forming apparatus according to claim 9, wherein the second opening is positioned below the exposure unit.

16. The image forming apparatus according to claim 1, further comprising a developing roller rotatably attached to one of the drum cartridge and the developing agent cartridge.

17. The image forming apparatus according to claim 16, wherein the developing roller is rotatably attached to the developing agent cartridge, and wherein the developing agent cartridge guide is configured such that, when the developing agent cartridge is attached to or detached from the main body, the developing roller passes below the exposure unit.

18. The image forming apparatus according to claim 16, wherein the developing roller is rotatably attached to the drum cartridge, and wherein the developing agent cartridge guide is configured such that, when the developing agent cartridge is attached to or detached from the main body, the developing agent cartridge passes below the developing roller.

19. The image forming apparatus according to claim 9, wherein the second cartridge includes a second image forming rotating element, and wherein the lower guide is configured such that, when the second cartridge is attached to or detached from the main body, the second image forming rotating element passes below the exposure unit.

20. The image forming apparatus according to claim 9, wherein the first cartridge includes a second image forming rotating element, and wherein the lower guide is configured such that, when the second cartridge is attached to or detached from the main body, the second cartridge passes below the second image forming rotating element.

* * * * *